US006138424A

United States Patent [19]

Akerson et al.

[11] Patent Number: 6,138,424

[45] Date of Patent: Oct. 31, 2000

[54] VENT APPARATUS FOR ATTACHMENT TO A BUILDING STRUCTURE

[75] Inventors: Derek Parnell Akerson, San Diego; Eugene Scott Sahota, New Castle, both of Calif.

[73] Assignee: Beutler Heating & Air Conditioning, Sacramento, Calif.

[21] Appl. No.: 09/123,856

[22] Filed: Jul. 28, 1998

[51] Int. Cl.[7] ..... E06B 1/02

[52] U.S. Cl. ..... 52/473; 52/302.1; 52/658.8; 52/799.11; 454/279; 454/283

[58] Field of Search ..... 52/473, 302.1, 52/799.11, 656.7, 656.8; 454/277, 279, 283

[56] References Cited

U.S. PATENT DOCUMENTS

| | | | |
|---|---|---|---|
| 2,820,407 | 1/1958 | Smith | 454/279 |
| 2,936,874 | 5/1960 | Bierwirth et al. | 454/279 |
| 5,349,799 | 9/1994 | Schiedegger et al. | 454/277 X |

FOREIGN PATENT DOCUMENTS

| | | | |
|---|---|---|---|
| 4030173452 | 1/1991 | Japan | 52/302.1 |
| 4213146 | 10/1993 | Netherlands | 52/302.1 |
| 196898 | 4/1938 | Switzerland | 52/473 |
| 379732 | 7/1964 | Switzerland | 52/473 |
| 2826 | 7/1908 | United Kingdom | 52/473 |
| 1131684 | 9/1966 | United Kingdom | 52/473 |

*Primary Examiner*—Carl D. Friedman
*Assistant Examiner*—Phi Dieu Tran A
*Attorney, Agent, or Firm*—Thomas R. Lampe

[57] ABSTRACT

Vent apparatus for a building includes a frame within which are positioned two spaced sets of louvers. The louvers of each set of louvers have openings therebetween and the openings of each set of louvers are covered by the louvers of the other set of louvers.

5 Claims, 3 Drawing Sheets

VENT APPARATUS FOR ATTACHMENT TO A BUILDING STRUCTURE

TECHNICAL FIELD

This invention relates to vent apparatus for attachment to a building structure for allowing passage of air through an opening in the building structure.

BACKGROUND OF THE INVENTION

It is well known in the art to utilize louvered vents, commonly called gable vents, in association with building structures to allow passage of air therethrough.

Typically, such vents incorporate a frame, usually rectangular, formed of sheet metal or other suitable material. Parallel spaced louvers are located within the frame, such louvers normally being inclined downwardly in the direction away from the building structure to divert rain water in an attempt to prevent the water from entering the interior of the building structure. This is not always successful, particularly when the rain is driven by wind in the direction of the building structure, that is, when the vent is on the "windward" side of the building. Water damage can then result.

Screens are commonly associated with prior art vent arrangements to prevent birds, relatively large insects, and other objects from passing into the building through the vent from the outside. However, such screens do not prevent or impede the passage of water through the vent.

DISCLOSURE OF INVENTION

The present invention relates to vent apparatus for attachment to a building structure for allowing passage of air through an opening in the building structure thus preventing or impeding the passage of rain water therethrough. The vent apparatus of the present invention is of unitary construction and can readily be installed in place at an opening in the building structure.

The vent apparatus has a frame including spaced frame end walls and having first and second frame sides.

The vent apparatus also includes a first set of louvers comprising a plurality of louvers attached to the frame and extending between the spaced end walls, the louvers of said first set of louvers being spaced from one another, defining openings therebetween, and extending inwardly from the first frame side toward the second frame side.

The vent apparatus also incorporates a second set of louvers comprising a plurality of louvers attached to said frame and extending between the spaced end walls. The louvers of said second set of louvers are spaced from one another, define openings therebetween, and extend inwardly from the second frame side toward the first frame side.

The louvers of said first set of louvers are spaced from and out of engagement with the louvers of the second set of louvers to define a space between the first set of louvers and the second set of louvers.

The louvers of the first set of louvers cover the openings between the louvers of the second set of louvers and the louvers of the second set of louvers cover the openings between the louvers of the first set of louvers.

A foraminous screen is attached to the frame.

Other features, advantages, and objects of the present invention will become apparent with reference to the following description and accompanying drawings.

BEST MODE FOR CARRYING OUT THE INVENTION

Figure 1:
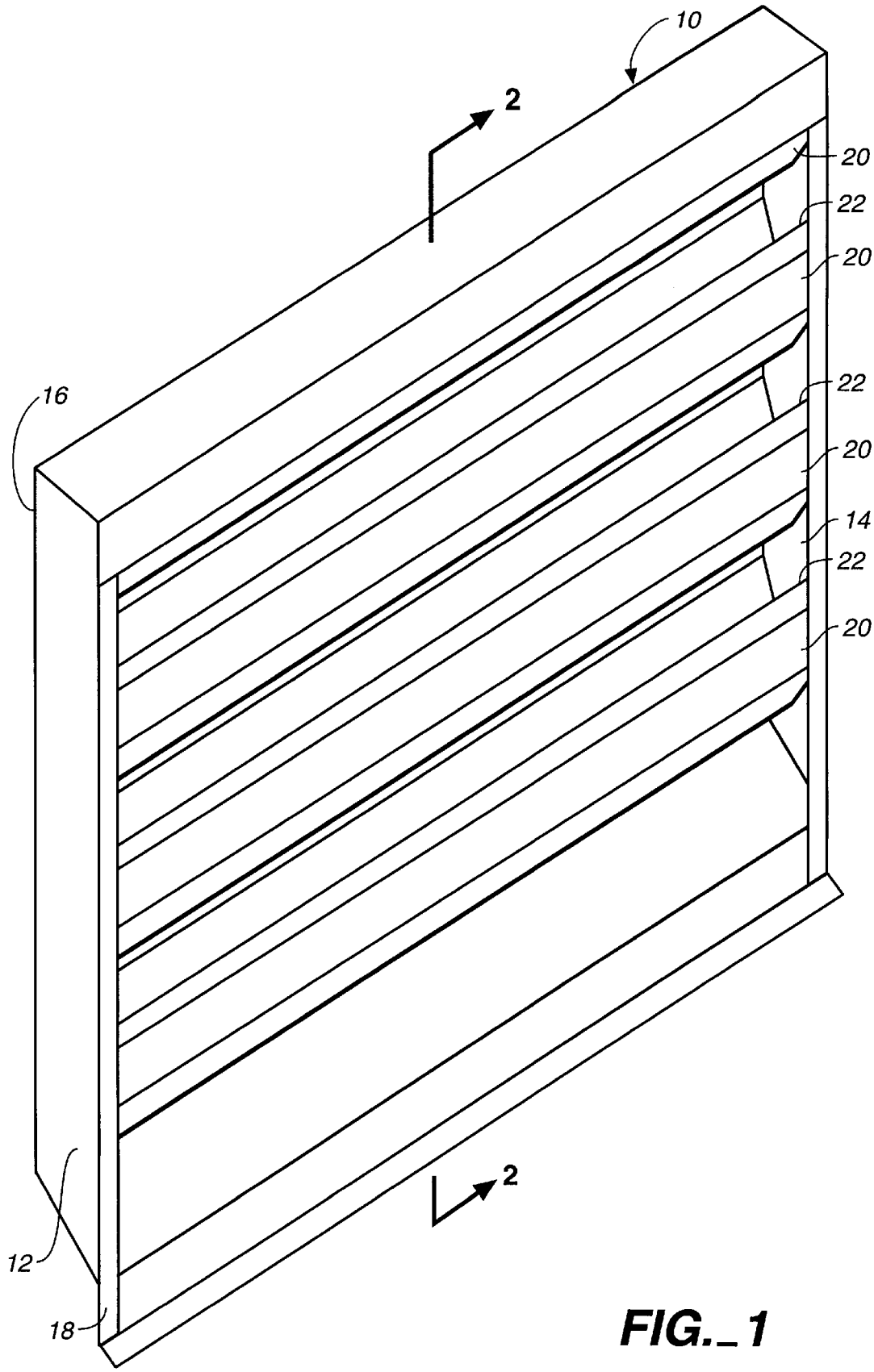
FIG. 1 is a perspective view of vent apparatus constructed in accordance with the teachings of the present invention.
Figure 2:
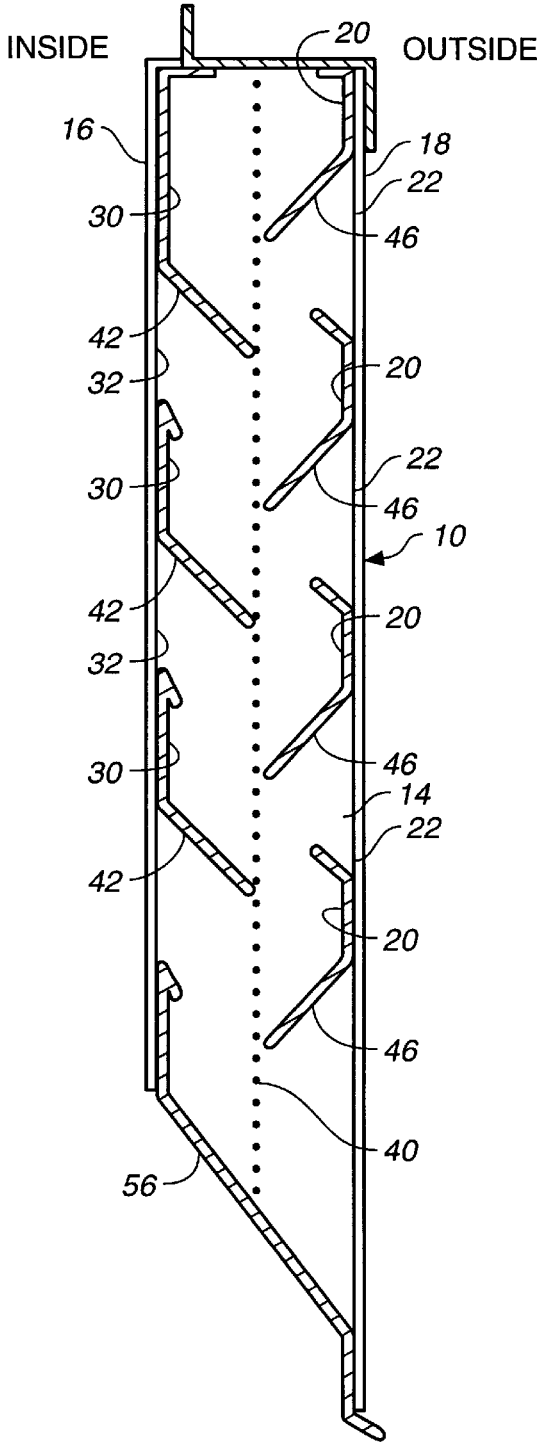
FIG. 2 is a cross-sectional view taken along the line 2—2 in FIG. 1.

Referring now to FIGS. 1 and 2, vent apparatus constructed in accordance with the teachings of the present invention is illustrated, such vent apparatus being of unitary construction and suitably formed from sheet metal.

The apparatus includes an open frame 10 having end walls 12, 14, an inner frame side 16, and an outer frame side 18.

Two sets of louvers are connected to frame 10. One set of louvers comprises a plurality of louvers 20 attached to frame 10 and extending between spaced end walls 12, 14. Louvers 20 are spaced from one another, defining openings 22 therebetween. Louvers 20 extend inwardly from frame side 18 toward frame side 16.

The vent apparatus also includes a second set of louvers comprising a plurality of louvers 30 attached to the frame 10 and extending between the spaced end walls 12, 14. Louvers 30 are spaced from one another, define openings 32 therebetween, and extend inwardly from the frame side 16 toward frame side 18.

The louvers 20 are spaced from and out of engagement with the louvers 30. Thus, a space is formed between the two sets of louvers. Positioned in the space and extending between end walls 12, 14 is a foraminous screen 40 (FIG. 2). Screen 40 is located between the two sets of louvers.

The spacing and configuration of the louvers is such that louvers 20 cover the openings 32 between louvers 30 and louvers 30 cover the openings 22 between louvers 20. Louvers 20 and louvers 30 are in partial registry.

Louvers 30 include lower segments 42 inclined downwardly in the direction of louvers 20. Similarly, louvers 20 have downwardly inclined lower segments 46. In the illustrated embodiment, the lower segments 46 of the top three louvers 20 are inclined in the direction of louvers 30. Louvers 20 also include an upper segment inclined upwardly in the direction of louvers 30.

The vent apparatus also includes an inclined bottom wall 56 oriented to the outside side of the vent apparatus.

Figure 3:
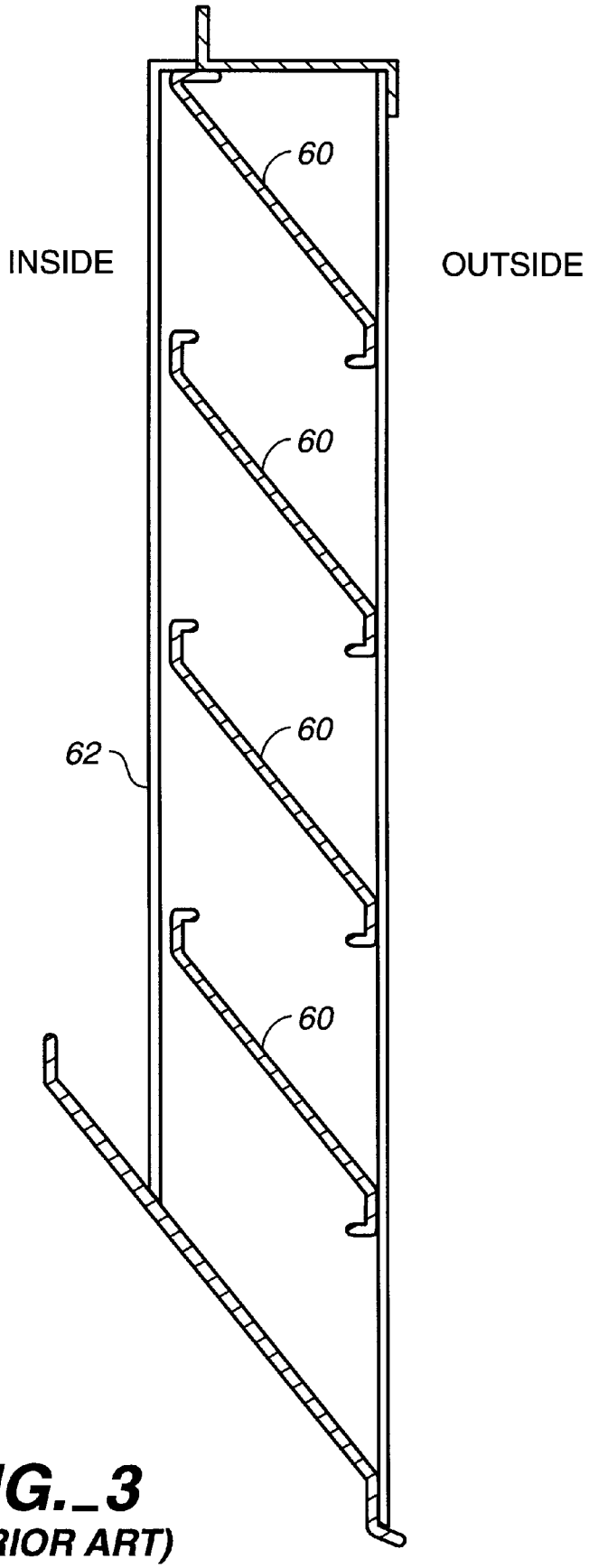
FIG. 3 (PRIOR ART)
FIG. 3 is a view similar to FIG. 2 but illustrating typical prior art vent apparatus.

It will be seen from the above description that the louvers 20, 30 cooperate to provide a labyrinthine passageway and that the louvers cooperate to make it extremely difficult for rainwater to pass completely through the vent apparatus and through openings 32. Under the influence of gravity, virtually all of the water will fall down to the bottom wall 56 and exit the vent apparatus outside the building structure. This is to be compared with the prior art type of vent illustrated in FIG. 3 wherein only a single set of louvers 60 is disposed in frame 62.

Figure 4:
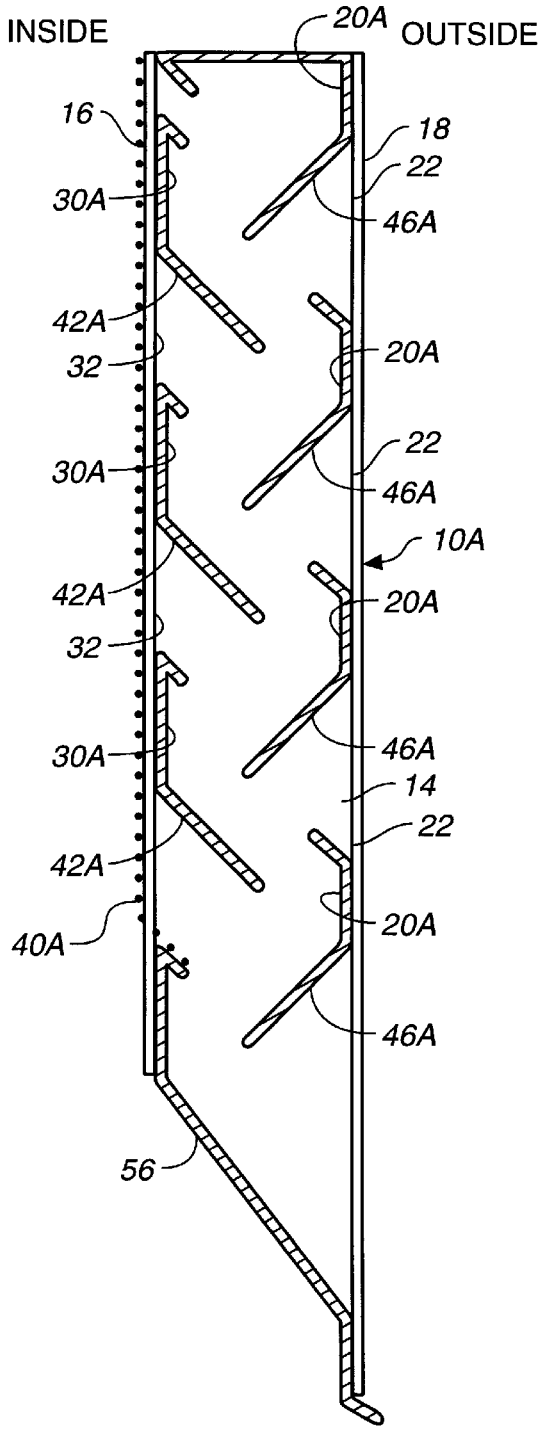
FIG. 4 is a view similar to FIG. 2 but illustrating an alternate embodiment of the invention.

FIG. 4 illustrates an alternate embodiment of the invention. In this embodiment the lower segments 46A and 42A of louvers 30A and 20A are somewhat lengthened. Screen 40A is located externally of frame 10A of the invention in this instance behind louvers 30A.

We claim:

1. Vent apparatus for attachment to a building structure for allowing passage of air through an opening in the building structure, said vent apparatus comprising, in combination:

a frame including spaced frame end walls and having first and second frame sides;

a first set of louvers comprising a plurality of louvers fixedly attached to said frame and extending between said spaced end walls, said louvers of said first set of louvers being spaced from one another, defining openings therebetween, and extending inwardly from said first frame side toward said second frame side; and a second set of louvers comprising a plurality of louvers fixedly attached to said frame and extending between said spaced end walls, said louvers of said second set of louvers being spaced from one another, defining openings therebetween, and extending inwardly from said second frame side toward said first frame side, the louvers of said first set of louvers being spaced from and out of engagement with the louvers of said second set of louvers to define a space between said first set of louvers and said second set of louvers, and the louvers of said first set of louvers covering the openings between the louvers of said second set of louvers and the louvers of said second set of louvers covering the openings between the louvers of said first set of louvers, at least some of the louvers of said first set of louvers including two louver segments including a vertically disposed planar upper louver segment directly attached to said frame and extending between said spaced end walls and a planar lower louver segment affixed to said upper louver segment and inclining downwardly therefrom in the direction of a louver of said second set of louvers, and at least some of the louvers of said second set of louvers including two louver segments including a vertically disposed, planar upper louver segment directly attached to said frame and extending between said spaced end walls and a planar lower louver segment affixed to the planar upper louver segment and inclining downwardly therefrom in the direction of a louver of said first set of louvers, the lower louver segments of the louvers of said first and second sets of louvers having free distal lower ends, and said louvers of said first and second sets of louvers terminating at said free distal ends.

2. The vent apparatus according to claim 1 wherein said frame additionally comprises an inclined bottom wall extending between said first and second frame sides and positioned under said first and second sets of louvers.

3. The vent apparatus according to claim 1 wherein said frame, said first set of louvers, and said second set of louvers are of unitary construction.

4. The vent apparatus according to claim 1 wherein at least some of the louvers of said first set of louvers are in partial registry with the louvers of said second set of louvers.

5. Vent apparatus for attachment to a building structure for allowing passage of air through an opening in the building structure, said vent apparatus comprising, in combination:

a frame including spaced frame end walls and having first and second frame sides;

a first set of louvers comprising a plurality of louvers attached to said frame and extending between said spaced end walls, said louvers of said first set of louvers being spaced from one another, defining openings therebetween, and extending inwardly from said first frame side toward said second frame side;

a second set of louvers comprising a plurality of louvers attached to said frame and extending between said spaced end walls, said louvers of said second set of louvers being spaced from one another, defining openings therebetween, and extending inwardly from said second frame side toward said first frame side; and a foraminous screen extending between said spaced end walls and located between said first set of louvers and said second set of louvers.

* * * * *